US008897481B2

(12) United States Patent
Sumitani et al.

(10) Patent No.: US 8,897,481 B2
(45) Date of Patent: Nov. 25, 2014

(54) GRILLE ATTACHMENT FOR LOUDSPEAKER

(71) Applicant: Sound Sources Technology, Inc., Torrance, CA (US)

(72) Inventors: Yoichiro Sumitani, Rancho Palos Verdes, CA (US); Chun-Yi Lin, New Taipei (CN); Yu-Ling Cheng, New Taipei (CN)

(73) Assignee: Sound Sources Technology, Inc., Torrance, CA (US)

( * ) Notice: Subject to any disclaimer, the term of this patent is extended or adjusted under 35 U.S.C. 154(b) by 145 days.

(21) Appl. No.: 13/772,175

(22) Filed: Feb. 20, 2013

(65) Prior Publication Data

US 2014/0233786 A1 Aug. 21, 2014

(51) Int. Cl.
*H04R 1/02* (2006.01)
*H04R 9/06* (2006.01)

(52) U.S. Cl.
CPC ..... *H04R 1/02* (2013.01); *H04R 1/025* (2013.01); *H04R 1/023* (2013.01)
USPC ..... 381/391; 381/395; 381/189; 381/433

(58) Field of Classification Search
CPC ..... H04R 1/02; H04R 1/023; H04R 1/026; H04R 2201/021
USPC ..... 381/391, 386, 392, 395, 189, 433
See application file for complete search history.

(56) References Cited

U.S. PATENT DOCUMENTS

| | | | | |
|---|---|---|---|---|
| 5,844,999 | A * | 12/1998 | Kameda et al. | 381/391 |
| 7,677,353 | B2 * | 3/2010 | Shinohara et al. | 381/391 |
| 2005/0281429 | A1 * | 12/2005 | Rivera | 381/391 |
| 2007/0098206 | A1 * | 5/2007 | Ando et al. | 381/391 |

* cited by examiner

*Primary Examiner* — Jesse Elbin
(74) *Attorney, Agent, or Firm* — Stetina Brunda Garred & Brucker

(57) ABSTRACT

A grille attachment for a loudspeaker is disclosed. A grille retainer is defined by a retention lip portion, a radial rim interface portion, and a hinge portion. The radial rim interface portion is in an abutting relationship with a flange radial mounting surface of the loudspeaker basket. The hinge portion connects the retention lip portion and the radial rim interface portion. The retention lip portion extends toward a flanged rim of the speaker basket, and defines an inner retention surface that is opposed to a flange circumferential surface. A grille extends across the griller retainer and is defined by a grille body and a grille rim that is circumferentially disposed and extending from the grille body. The grille rim is interposed between the flange circumferential surface and the inner retention surface, with the retention lip portion exerting a radial compressive force against the grille rim.

20 Claims, 4 Drawing Sheets

GRILLE ATTACHMENT FOR LOUDSPEAKER

CROSS-REFERENCE TO RELATED APPLICATIONS

STATEMENT RE: FEDERALLY SPONSORED RESEARCH/DEVELOPMENT

Not Applicable

BACKGROUND

1. Technical Field

The present invention generally relates to loudspeakers, and more particularly to a loudspeaker having a flexible rim for removably attaching a grille thereto.

2. Related Art

Loudspeakers are generally defined by an anterior side and a posterior side, relative to the conventional mounting configuration. The dominant feature typically visible on the anterior side is the front face of a cone or diaphragm, together with the dust cap, and a surround that suspends the diaphragm from an interior rim of a basket. The posterior side is characterized by a basket and a magnet attached to the base thereof, a stabilizer or spider, and terminals for connecting the loudspeaker to an electrical signal source. Furthermore, the rear face of the diaphragm is visible from the posterior side. The diaphragm is mechanically coupled to a voice coil that reciprocates along the magnet, with movement corresponding to the electrical signal being produced as a result of the variable electromagnetic field.

The loudspeaker driver is mounted to other structures such as enclosures, walls, automotive wall structures, and the like. The surfaces of such structures are generally referred to in the art as baffles, and the loudspeakers are mounted thereto for stability, for directing the generated sound waves, and for improved acoustic characteristics. The sound waves generated by the loudspeaker in the direction of the front face is out of phase with the sound waves generated in the reverse direction of the front face, leading to the cancellation of the in-phase sound wave. It has been recognized that the baffle prevents such interference produced by the out-of-phase sound wave.

The shape and configuration of baffles may be considerably varied depending on the application, but are typically planar and have a front side and a back side. The baffle defines a hole having a sufficient diameter such that the posterior side of the loudspeaker fits through the hole and is positioned on the back side of the baffle. Further, the diameter of the hole will be less than that of the front face of the loudspeaker driver, thereby preventing the entirety of the loudspeaker to slide through the hole. The loudspeaker driver is mounted to the baffle in such a configuration that the rim of the basket abuts against the front side of the baffle. Various fasteners can be used to thereby secure the basket rim to the baffle, including screws, bolts and the like driven through the basket and the baffle and retained by corresponding nuts.

In order to protect the delicate diaphragm of the driver from damage resulting from foreign objects, a grille may be attached to the front face of the loudspeaker. Either soft or hard type grilles may be used, depending on the specific application parameters. A variety of mounting modalities are known in the art, the most basic of which is to utilize the same fastener that is used to secure the basket rim to the baffle, to additionally secure the grille to the basket rim. This mounting modality leaves the head of the fasteners visible on the front face of the grille, thus interrupting the aesthetics of the structure and the loudspeaker.

Alternatively, mounting posts projecting from basket rim may be utilized. The posts may be arranged around the rim of the basket in alignment with corresponding adapters on the rear face of the grille that receive the posts. The adapters typically have biased retention members such as leaf springs that lock on to the posts.

Physical retention of grilles mounted thus can be problematic for a number of different reasons. For instance, because the grille is in the direct radiation path of the sound waves generated by the diaphragm, it is subject to vibrations that may weaken the biased retention members over time. These vibrations are transmitted directly to the mounting posts because those are the only points of contact with a peripheral component, i.e., the loudspeaker driver and/or the baffle, to which the vibration can be dissipated. Furthermore, frequent decompression-compression cycles associated with the removal and attachment of the grille also contributes to the weakening retention of the grille. With the loosened retention of the grille, the entire assembly may exhibit undesirable ringing, as well as the complete separation of the grille from the face of the loudspeaker.

Accordingly, there is a need in the art for an improved grille attachment for a loudspeaker that securely retains the grille without interrupting the aesthetics of its front face. Additionally, there is a need in the art for a loudspeaker grille attachment or mount with minimal vibration.

BRIEF SUMMARY

Various embodiments of the present disclosure contemplate a loudspeaker mountable to a baffle. The loudspeaker may include a speaker basket with a basket body and a flanged rim circumferentially extending from the basket body. The flanged rim may be defined by a flange circumferential surface and a flange radial mounting surface disposed generally orthogonal to the flange circumferential surface.

The loudspeaker may also include a grille retainer that is concentric with the speaker basket. The grille retainer may be defined by a retention lip portion, a radial rim interface portion, and a hinge portion. The radial rim interface portion may be in an abutting relationship with the flange radial mounting surface. The hinge portion may connect the retention lip portion and the radial rim interface portion. Furthermore, the retention lip portion may extend towards the flanged rim of the speaker basket, and may further define an inner retention surface that is opposed to the flange circumferential surface.

There may additionally be a grille that is concentric with and extending across the griller retainer and the speaker basket. The grille may be defined by a grille body and a grille rim that is circumferentially disposed and extending from the grille body. The grille rim may be interposed between the flange circumferential surface and the inner retention surface. The retention lip portion may exert a radial compressive force against the grille rim.

Another embodiment of the present disclosure contemplates a bezel assembly for a loudspeaker driver with a flanged rim. The assembly may include an annular grille retainer with a base segment that defines a first inner circumference and an outer circumference of the annular grille retainer. The annular grille retainer may also have a bezel face segment that extends contiguously from the outer circumference and at least partially toward the inner circumference to define a second inner circumference of the annular grille retainer. This second inner circumference may be offset from the first inner circumference. The bezel face may define an exterior face and an interior face opposite the top surface. The base segment may be further defined by a top surface with a closed section that is obstructed by the bezel face segment and an open section receptive to the flanged rim of the loudspeaker driver. The assembly may also include a grille defined by a grille body, a grille rim, and one or more tabs oriented orthogonally to the grille rim. The grille may be attachable to the annular grille retainer and compressively retained thereon by a first force against the grille rim from the second inner circumference of the bezel face segment toward the flanged rim, and a second force against the one or more tabs from the interior face of the bezel face segment toward the top surface of the base segment.

The presently contemplated embodiments will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of the presently preferred embodiment of a grille attachment for a loudspeaker and is not intended to represent the only form in which the present apparatus may be developed or utilized. The description sets forth the functions and features of the grille attachment in connection with the illustrated embodiment. It is to be understood, however, that the same or equivalent functions and sequences may be accomplished by different embodiments that are also intended to be encompassed within the spirit and scope of the invention. It is further understood that the use of relational terms such as first, second, top, bottom, distal, proximal, and the like are used solely to distinguish one from another entity without necessarily requiring or implying any actual such relationship or order between such entities.

Figure 1:
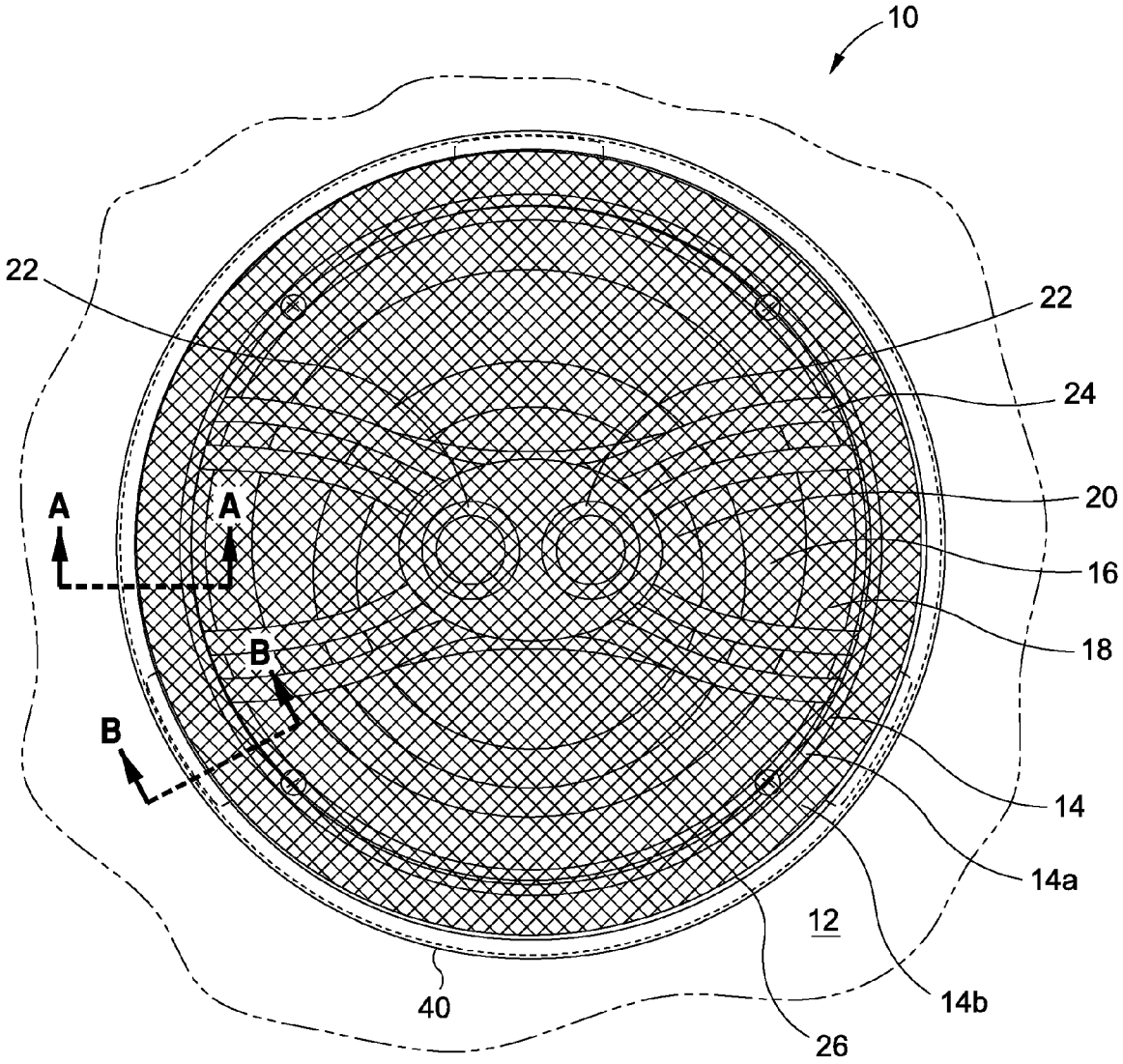
FIG. 1 is a top plan view of an exemplary loudspeaker driver with a grille secured to a rim thereof.
Figure 2:
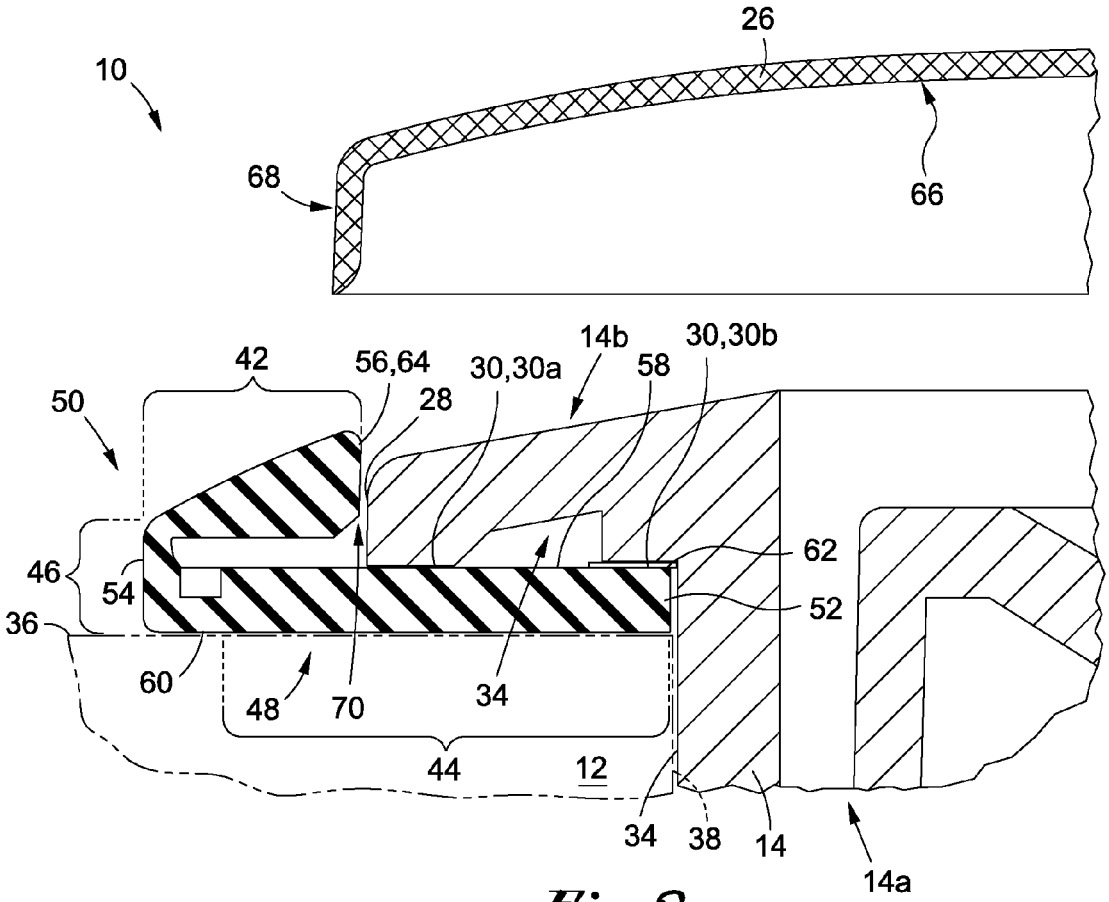
FIG. 2 is a cross-sectional view along section A of FIG. 1 of a flanged rim of a basket of the loudspeaker driver, a grille retainer, and a grille separated therefrom.

With reference to FIG. 1 and FIG. 2, one embodiment of a loudspeaker 10 is shown mounted to a baffle 12. Generally, the loudspeaker 10 is comprised of a frame or speaker basket 14, from which a diaphragm 16 is suspended via a flexible surround 18. The speaker basket 14 is defined by a basket body 14*a* and a flanged rim 14*b* that circumferentially extends from the basket body 14*a*. A central portion of the diaphragm 16 may also be referred to as a dust cover 20. Although not shown, those having ordinary skill in the art will recognize that mounted to the reverse side of the surround 18 and the dust cover 20 is a bobbin, around which a voice coil is wound. The wiring of the voice coil is connected to an electrical signal source, and interacts with a magnet mounted to a lower portion of the speaker basket 14. Specifically, the magnet, together with a pole piece, defines an air gap within which the voice coil and the bobbin reciprocate. The excursion of the voice coil corresponds to the electrical signals that are representative of the sound to be reproduced, and such movement/vibration is transferred to the diaphragm 16, the corresponding movement of air as a result being sound.

In addition to the primary driver that includes the diaphragm 16, the illustrated loudspeaker 10 includes a pair of tweeters 22 that are mounted to a bridge structure 24 spanning the diameter of the speaker basket 14. As will also be recognized by those having ordinary skill in the art, the smaller the diaphragm and associated moving components of any loudspeaker, the faster it can vibrate, meaning that higher sound frequencies can be reproduced. The opposite is true of larger diaphragms and associated moving components. Although modern materials allow sound reproduction over a wide frequency range, the design of the loudspeaker 10 is nevertheless an exercise in compromise between low, mid, and high frequency response characteristics. In this regard, the example loudspeaker 10 contemplates the use of multiple drivers for specific frequency ranges as is typical practice.

Although a specific embodiment of the loudspeaker 10 has been shown and described, it is to be understood that this is by way of example only and not of limitation. Any other suitable configuration of a loudspeaker 10 may be substituted without departing from the scope of the present disclosure. The foregoing has been shown for contextual background purposes prior to a consideration of an additional apparatus for mounting a grille 26 to the face of the loudspeaker 10. The grille 26 is a disk-shaped structure that obstructs the diaphragm 16 from damage resulting from foreign objects. As briefly mentioned above, the diaphragm 16 is typically constructed of lightweight, though fragile materials, and so the grille 26 can be constructed of a hard plastic or metallic material to absorb any shock or piercing object. However, the sound waves generated by the diaphragm 16 must be passed through with minimal distortion, so the grille 26 has a mesh surface.

Figure 3:
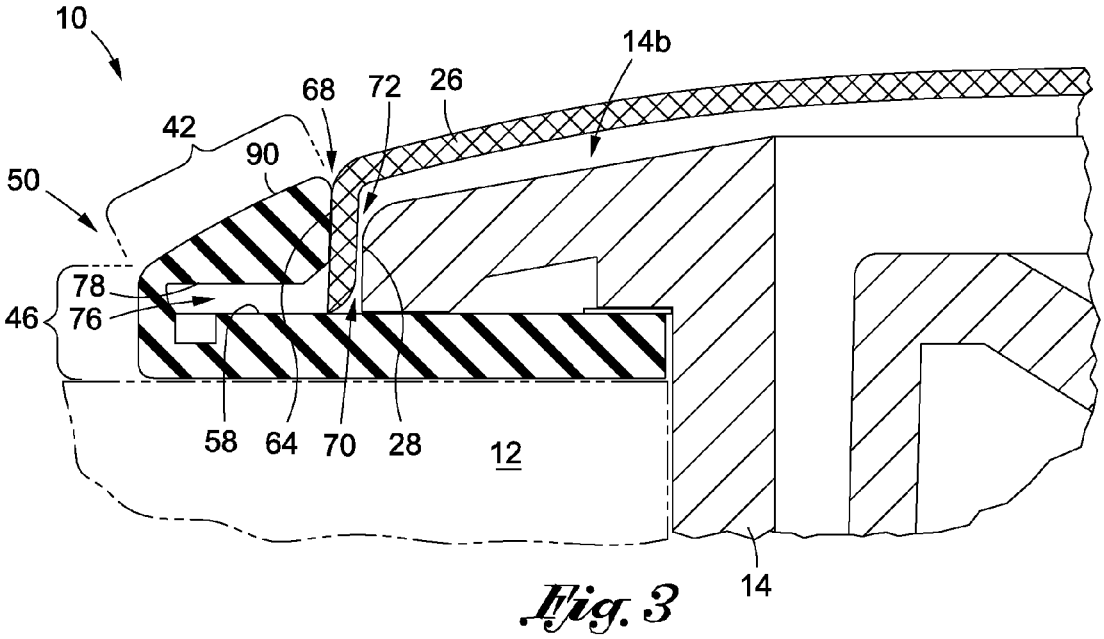
FIG. 3 is a cross-sectional view along section A of FIG. 1 of the flanged rim, the grille retainer, and the grille installed thereon.

Referring specifically to the cross sectional views of FIG. 2 and FIG. 3, the flanged rim 14*b* is further defined by a flange circumferential surface 28, as well as a flange radial mounting surface 30. It is contemplated that the flange circumferential surface 28 is generally orthogonal to the flange radial mounting surface 30. According to the illustrated embodiment, the flanged rim 14*b* includes a flange groove 32 that segregates the flange radial mounting surface 30 into a first section 30*a* and a second section 30*b*. However, in other embodiments it is also possible to eliminate the flange groove 32, thus making the flange radial mounting surface 30 continuous.

The basket body 14*a* also defines a body wall 34 that is substantially orthogonal to the flange radial mounting surface 30. The baffle 12 is characterized by a top surface 36 as well as a hole through which the basket body 14*a* is inserted, and so there is an inner side surface 38 that defines such hole and extends perpendicularly to the top surface 36. The diameter of the hole is sized to fit the outer diameter of the basket body 14*a*. Some degree of frictional fit between the inner side surface 38 and the body wall 34 may be appropriate.

Although terms such as "top," "bottom," and "side" are utilized in connection with the description of the illustrated embodiments, it is understood that such reference is for sake of convenience only, and are not intended to be limiting. For example in FIG. 2, the surface of the baffle 12 facing the radiating direction of the loudspeaker 10 is referred to as the "top" surface 36. In the particular orientation of the loudspeaker 10 shown in FIG. 2, it would be appropriate to reference this surface as the "top," though this may not hold true for another embodiment in which the loudspeaker is mounted sideways. With such an embodiment, it may be more appropriate to reference the same surface as a "side" surface rather than a "top" surface. Nevertheless, for purposes of consistency, any such alternative may also be described with the same terms. Those having ordinary skill in the art will recognize the appropriate translations that would accompany such minor modifications in orientation.

Figure 5:
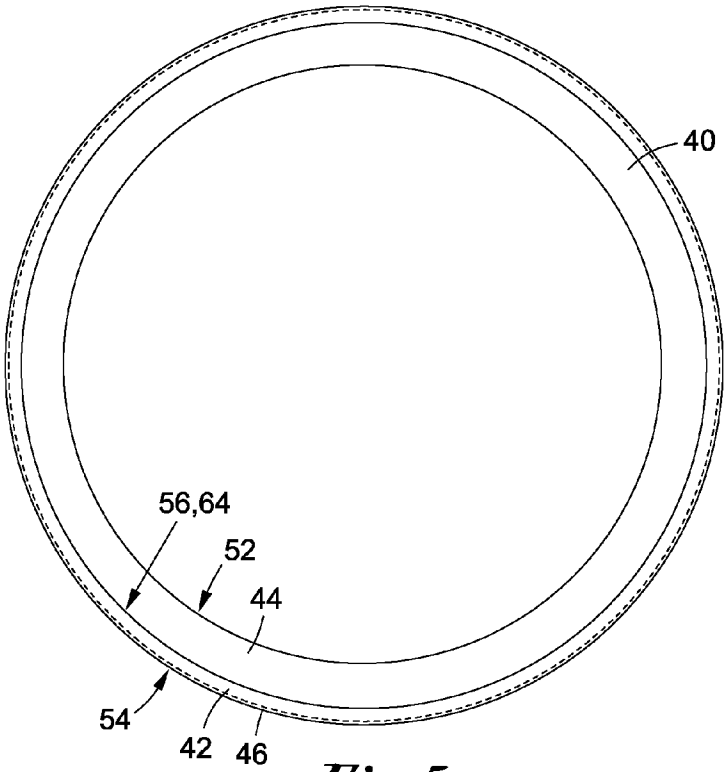
FIG. 5 is a top plan view of a grille retainer.

Various embodiments of the present disclosure contemplate a grille retainer 40 has an annular shape and is concentric with the flanged rim 14*b* of the speaker basket 14. As further illustrated in FIGS. 2 and 5, the grille retainer 40 is generally defined by a retention lip portion 42, a radial rim interface portion 44, and a hinge portion 46 that connects the retention lip portion 42 and the radial rim interface portion 44. The radial rim interface portion 44 may also be referred to as a base segment 48, and the retention lip portion may also be referred to as a bezel face segment 50. It is understood that there is no clear delineation between the radial rim interface portion 44 and the hinge portion 46, as well as between the retention lip portion 42 and the hinge portion 46. A part of the hinge portion 46 and the retention lip portion 42 may together define the bezel face segment 50, while a part of the hinge portion 46 and the radial rim interface portion 44 may together define the base segment 48.

Broadly, the base segment 48 may define an inner circumference 52 and an outer circumference 54 of the overall structure of the grille retainer 40. In this context, the bezel face segment 50 is understood to extend contiguously from the outer circumference 54. The retention lip portion 42, and hence the bezel face segment 50, extend radially inwardly toward the center of grille retainer 40, i.e., back toward the inner circumference 52, to define a second inner circumference 56. The second inner circumference 56 is vertically offset from the inner circumference 52.

The radial rim interface portion 44, i.e., the base segment 48, is defined by a top surface 58 and an opposed bottom surface 60. The bottom surface 60 is also understood to be that of the grille retainer 40. According to one contemplated installation, the grille retainer 40 is first mounted to the baffle 12, such that the top surface 36 of the baffle 12 is in an abutting relationship with the bottom surface 60 of the base segment 48. The speaker basket 14 is then mounted to the grille retainer 40, such that the flange radial mounting surface 30 of the flanged rim 14*b* is in an abutting relationship with the top surface 58. That part of the top surface 58 obstructed by the bezel face segment 50 may also be referred to as a closed section, while the part that interfaces with the flanged rim 14*b* may be referred to as an open section because prior to such installation of the speaker basket 14, it remains open and unobstructed.

In order to secure the speaker basket 14 to the grille retainer 40, glue may be applied to an interface 62 between the second section 30*b* and the top surface 58. While maximizing the surface area of contact between the top surface 36 of the baffle 12 and the bottom surface 60 of the grille retainer 40, the inner circumference 52 may be sized and configured to correspond to the circumference of the hole in the baffle 12 through which the speaker basket 14 is inserted as discussed above. In other words, the inner circumference 52 is substantially coextensive with the hole. As such, the inner circumference 52 may be in substantial alignment with and parallel to the body wall 34 of the baffle 12.

With the speaker basket 14 mounted to the grille retainer 40, as shown in FIG. 2, the retention lip portion 42 extends towards the flanged rim 14*b* of the speaker basket 14, that is, toward the flange circumferential surface 28. The second inner circumference 56 may also be referred to as an inner retention surface 64, which is opposed to the flange circumferential surface 28. The retention lip portion 42 and the flange circumferential surface 28 cooperatively define a vertical crevice 70.

Figure 6:
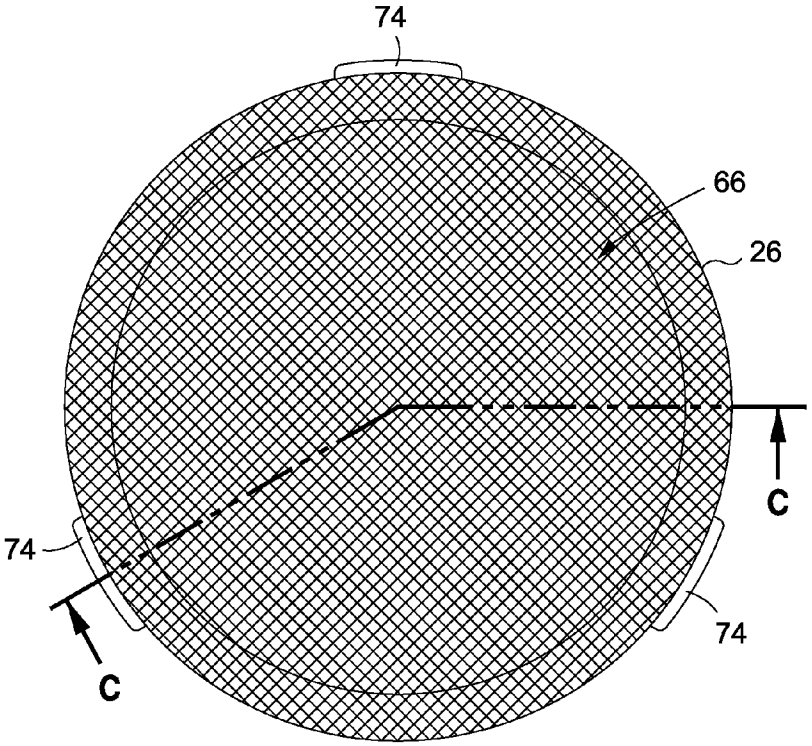
FIG. 6 is a top plan view of the grille in accordance with one embodiment of the present disclosure.
Figure 7:
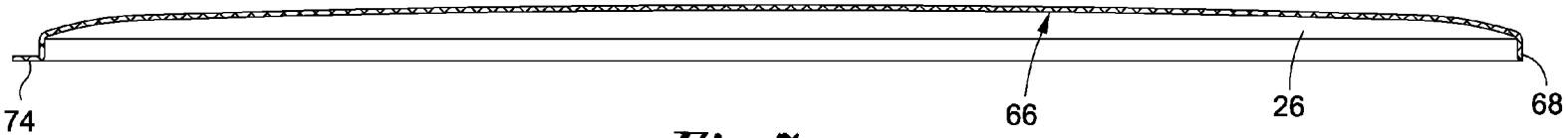
FIG. 7 is a cross-sectional view of the grille along section C-C of FIG. 6.

The present disclosure contemplates the secure mounting of the grille 26 to the face of the loudspeaker 10 with the grille retainer 40, and so the grille 26 has various features therefor. As best shown in FIG. 1, FIG. 6 and FIG. 7, the grille 26 has a circular, disk-shaped configuration and is concentric with the speaker basket 14, and extends across the same. It is generally defined by a grille body 66 as well as a grille rim 68 that circumferentially extends therefrom. With reference to FIG. 3, the grille rim 68 is received within the aforementioned vertical crevice 70. That is, the grille rim 68 is interposed between the flange circumferential surface 28 and the inner retention surface 64.

The retention lip portion 42, and indeed, the entirety of the grille retainer 40, can be constructed of a semi-rigid, flexible elastomeric material such as rubber. In the particular example shown, the retention lip portion 42 exerts an inwardly radial compressive force against the grille rim 68. Because such force is radial, that is, exerted against the entire circumference of the grille rim 68, resistance thereto is encountered from the diametrically opposite points along the same grille retainer 40. One of the advantages of this configuration is the uniform contact of the grille 26 to the grille retainer 40, thus maximizing the contact surface area for shock and vibration absorption. Depending on the resonance characteristics of the elastomeric material used for the grille retainer 40, the equal dispersion of vibration can be optimized. Since there is less shock being transferred through any given point on the grille retainer 40, retention is improved.

Generally, the compressive radial force is expected to be insufficient to compress the rigid grille body 66 against the flange circumferential surface 28. With the grille 26 being slightly oversized in relation to the circumference of the flanged rim 14*b*, a slight gap 72 remains. The vertical crevice 70 as initially defined without the grille rim 68 inserted therein has a width less than that of the grille rim 68 itself. The tip of the grille rim 68 may thus be tapered to ease the insertion force necessary to separate the retention lip portion 42 from the flange circumferential surface 28.

Figure 4:
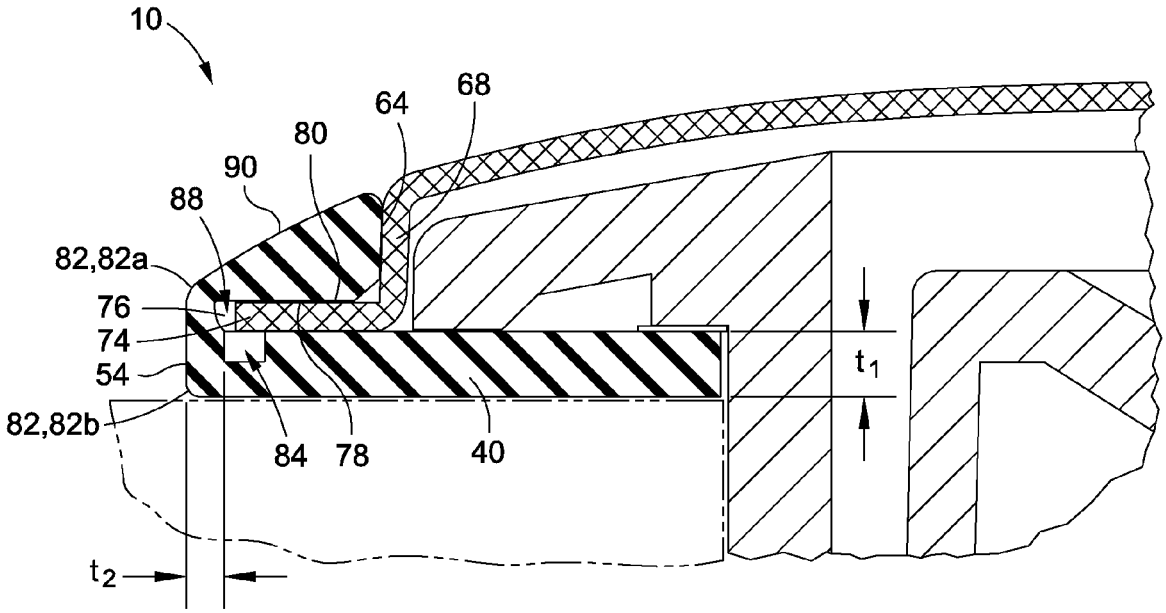
FIG. 4 is a cross-sectional view along section B of FIG. 1 of the flanged rim, the grille retainer, and the grille installed thereon with its tabs shown.

An additional level of retention is contemplated to prevent unwanted withdrawal of the grille rim 68 from the vertical crevice 70. As shown in FIG. 4, FIG. 6, and FIG. 7, the grille 26 also has one or more distal tabs 74 that are generally orthogonal to the grille rim 68 and extend radially therefrom. The distal tabs 74 may be distributed along the circumference of the grille 26 in a spaced relationship, and the number and lengths of each may be varied without departing from the scope of the present disclosure. As best shown in FIG. 3, in order to accommodate the distal tabs 74, there is a horizontal crevice 76 cooperatively defined by the retention lip portion 42 and the radial rim interface portion 44. More particularly, the horizontal crevice 76 is defined by the top surface 58 and an interior face 78 of the bezel face segment 50, also the retention lip portion 42. The aforementioned vertical crevice 70 is contiguous with the horizontal crevice 76. The interior face 78 is opposed to and spaced relative to the top surface 58, and further, extends from the hinge portion 46 to the inner retention surface 64. With reference to FIG. 4, the distal tab 74 is inserted into the horizontal crevice 76, and is retained therein based upon a second compressive, force exerted against a tab top surface 80 from the interior face 78 that abuts it. This force is understood to be axial, that is, aligned with a central radiating direction of the diaphragm 16. This second force is orthogonal to the earlier described first force against the grille rim 68.

The hinge portion 46 is referred to as such because it is the general area about which the retention lip portion 42 is rotated to open access to the horizontal crevice 76 for the distal tabs 74. More particularly, each bend 82 along an exterior of the grille retainer 40 adjacent to the outer circumference 54 flexes, and therefore defines a pivot point. The cross-sectional thicknesses throughout the retention lip portion 42, particularly at the bends 82, are substantially the same so that there is no excess strain at any given pivot point, and that the flex is distributed to prevent damage and permanent deformation of the material. In this regard, a part of the hinge portion 46 that is otherwise co-extensive with the radial rim interface portion 44 defines a circumferential groove 84. An additional potential pivot point 82*c* at this interface is envisioned to exhibit minimal flexing due to its abutment against the top surface 36 of the baffle 12, however. It is contemplated that most of the flexing is to occur at the first bend 82*a* rather than the second bend 82*b*, so the cross sectional thickness at the former is slightly less than that of the latter. The thinner cross sections are understood to flex more, while thicker cross sections are understood to flex less. As such the interface between the hinge portion 46 and the retention lip portion 42 defines an inner notch 88 that reduces the cross-sectional thickness thereof.

Aside from that portion of the hinge portion 46 that defines the inner notch 88, a cross-sectional thickness t2 thereof is contemplated to be relatively constant. However, in comparison to a cross sectional thickness t1 of the radial rim interface portion 44, it is understood to be less. Similarly, for most parts of the retention lip portion 42, its cross-sectional thickness is understood to be greater than that of the hinge portion 46.

Referring to FIG. 3 and FIG. 4, the cross-sectional thickness of the retention lip portion 42 is understood to be non-uniform. In the illustrated embodiment, the cross-sectional thickness increases from adjacent the hinge portion 46 toward the inner retention surface 64. Opposite the interior face 78 of the bezel face segment 50, i.e., the retention lip portion 42, there is an exterior face 90. The contour of the exterior face 90 is configured to be substantially contiguous with the contour or curvature of the grille body 66, so with that rising contour, there is a corresponding increase in the cross sectional thickness.

The particulars shown herein are by way of example and for purposes of illustrative discussion of the embodiments of the present invention only and are presented in the cause of providing what is believed to be the most useful and readily understood description of the principles and conceptual aspects of the grille attachment. In this regard, no attempt is made to show more details than is necessary for a fundamental understanding of the disclosure, the description taken with the drawings making apparent to those skilled in the art how the several forms of the presently disclosed methods may be embodied in practice.

What is claimed is:

1. A loudspeaker mountable to a baffle, comprising:

a speaker basket including a basket body and a flanged rim circumferentially extending from the basket body, the flanged rim being defined by a flange circumferential surface and a flange radial mounting surface disposed generally orthogonal to the flange circumferential surface;

a grille retainer concentric with the speaker basket and defined by a retention lip portion, a radial rim interface portion in an abutting relationship with the flange radial mounting surface, and a hinge portion connecting the retention lip portion and the radial rim interface portion with the retention lip portion extending towards the flanged rim of the speaker basket, the retention lip portion further defining an inner retention surface opposed to the flange circumferential surface; and a grille concentric with and extending across the griller retainer and the speaker basket, the grille being defined by a grille body and a grille rim circumferentially disposed and extending from the grille body, the grille rim being interposed between the flange circumferential surface and the inner retention surface with the retention lip portion exerting a radial compressive force against the grille rim.

2. The loudspeaker of claim 1, wherein the retention lip portion and the radial rim interface portion of the grille retainer cooperatively define a horizontal crevice extending from the hinge portion to the inner retention surface.

3. The loudspeaker of claim 2, wherein the grille further includes a distal tab extending radially from the grille rim, the distal tab being disposed in the horizontal crevice with an axial compressive force being exerted upon the distal tab in a substantially orthogonal relationship to the radial compressive force being exerted against the grille rim.

4. The loudspeaker of claim 3, wherein a plurality of the distal tabs are spaced along the circumference of the grille rim.

5. The loudspeaker of claim 2, wherein the hinge portion of the grille retainer is flexible.

6. The loudspeaker of claim 5, wherein the hinge portion defines a pivot point, the retention lip portion being rotatable about the pivot point to open the crevice for insertion of the distal tab of the grille therein.

7. The loudspeaker of claim 1, wherein the hinge portion has a cross sectional thickness less than a cross-sectional thickness of the radial rim interface portion of the grille retainer.

8. The loudspeaker of claim 1, wherein the hinge portion a cross sectional thickness less than a cross-sectional thickness of the retention lip portion of the grille retainer.

9. The loudspeaker of claim 8, wherein the retention lip portion has a non-uniform cross-sectional thickness.

10. The loudspeaker of claim 8, wherein the cross-sectional thickness of the retention lip portion increases from adjacent the hinge portion toward the inner retention surface.

11. The loudspeaker of claim 1, wherein a frontal face of the grille retainer is contoured in substantial alignment with a curvature of the grille body.

12. The loudspeaker of claim 1, wherein the grille retainer is constructed of an elastomeric material.

13. The loudspeaker of claim 11, wherein the elastomeric material is rubber.

14. The loudspeaker of claim 1, wherein the grille retainer is fixed to the baffle, and the flanged rim of the speaker basket is fixed to the grille retainer in an abutting relationship with the flange radial mounting surface.

15. The loudspeaker of claim 14, wherein the flanged rim of the speaker basket is glued to the grille retainer baffle.

16. The loudspeaker of claim 14, wherein the radial rim interface portion defines an interior circumference substantially coextensive with an opening defined by the baffle for insertion of the speaker basket.

17. The loudspeaker of claim 1, wherein the retention lip portion of the grille retainer and the flange circumferential surface of the flanged rim cooperatively define a vertical crevice within which the grille rim is received.

18. The loudspeaker of claim 17, wherein the retention lip portion and the radial rim interface portion of the grille retainer cooperatively define a horizontal crevice extending from the hinge portion to the inner retention surface.

19. The loudspeaker of claim 18, wherein the horizontal crevice and the vertical crevice are contiguous.

20. A bezel assembly for a loudspeaker driver having a flanged rim, the assembly comprising:

an annular grille retainer with a base segment defining a first inner circumference and an outer circumference of the annular grille retainer, and a bezel face segment extending contiguously from the outer circumference and at least partially toward the inner circumference to define a second inner circumference of the annular grille retainer offset from the first inner circumference, the bezel face defining an exterior face and an interior face opposite the top surface, and the base segment being defined by a top surface with a closed section obstructed by the bezel face segment and an open section receptive to the flanged rim of the loudspeaker driver; and a grille defined by a grille body, a grille rim, and one or more tabs oriented orthogonally to the grille rim, the grille being attachable to the annular grille retainer and compressively retained thereon by a first force against the grille rim from the second inner circumference of the bezel face segment toward the flanged rim, and a second force against the one or more tabs from the interior face of the bezel face segment toward the top surface of the base segment.

* * * * *